US005523652A

United States Patent [19]

Sferlazzo et al.

[11] Patent Number: 5,523,652

[45] Date of Patent: Jun. 4, 1996

[54] MICROWAVE ENERGIZED ION SOURCE FOR ION IMPLANTATION

[75] Inventors: Piero Sferlazzo, Lynnfield, Mass.; Peter H. Rose, North Conway, N.H.; Frank R. Trueira, York, Me.

[73] Assignee: Eaton Corporation, Cleveland, Ohio

[21] Appl. No.: 312,142

[22] Filed: Sep. 26, 1994

[51] Int. Cl.[6] ..... H01J 7/24

[52] U.S. Cl. ..... 315/111.41; 315/111.81; 313/363.1

[58] Field of Search ..... 315/111.81, 39, 315/111.41; 250/427, 425, 492.2, 423 R; 313/360.1, 363.1

[56] References Cited

U.S. PATENT DOCUMENTS

| | | | |
|---|---|---|---|
| 4,714,834 | 12/1987 | Shubaly | 250/427 |
| 4,780,642 | 10/1988 | Jacquot | 313/359.1 |
| 4,883,968 | 11/1989 | Hipple et al. | 250/423 R |
| 5,026,997 | 6/1991 | Benveniste | 250/492.2 |
| 5,032,202 | 7/1991 | Tsai et al. | 156/345 |

OTHER PUBLICATIONS

Hutchinson, I. H., Principles of Plasma Diagnostics, Cambridge University Press, Contents, pp. vii–xi (1987).

Root, J., et al., "Experimental Performance of a Microwave Cavity Plasma Disk Ion Source," *Review of Scientific Instruments,* vol. 56, No. 8, pp. 1511–1519 (Aug. 1985).

Sakudo, N., "Microwave Ion Source for Ion Implantation," Nuclear Instruments and Methods in Physics Research, B21, pp. 168–177 (1987).

*Primary Examiner*—Robert Pascal
*Assistant Examiner*—David H. Vu
*Attorney, Agent, or Firm*—Watts, Hoffmann, Fisher & Heinke Co.

[57] ABSTRACT

A microwave energized ion source apparatus is supported by a support tube extending into a cavity defined by a housing assembly and includes a dielectric plasma chamber, a pair of vaporizers, a microwave tuning and transmission assembly and a magnetic field generating assembly. The chamber defines an interior region into which source material and ionizable gas are routed. The chamber is overlied by a cap having an arc slit through which generated ions exit the chamber. The microwave tuning and transmission assembly, which feeds microwave energy to the chamber in the TEM mode, includes a coaxial microwave energy transmission line center conductor. One end of the conductor fits into a recessed portion of the chamber and transmits microwave energy to the chamber. The center conductor extends through an evacuated portion of a coaxial tube surrounding the conductor. A vacuum seal is disposed in or adjacent the coaxial tube and from the boundary between the evacuated coaxial tube and a non-evacuated region. The arc slit cap is secured to a chamber housing surrounding the chamber and is adapted to interfit with a clamping assembly secured to an end of the support tube such that the arc slit is aligned with a predetermined ion beam line. The energy transmission center conductor is coupled to a tuning center conductor which is slideably overlied by a pair of slug tuners. Moving the slug tuners along their paths of travel changes an impedance of the microwave energy input to the chamber.

27 Claims, 8 Drawing Sheets

MICROWAVE ENERGIZED ION SOURCE FOR ION IMPLANTATION

FIELD OF THE INVENTION

The present invention concerns an ion source apparatus for use in an ion beam implantation system and, more particularly, a microwave energized ion source apparatus for generating ions from source materials routed to a dielectric plasma chamber.

BACKGROUND OF THE INVENTION

Ion beams can be produced by many different types of ion sources. Initially, ion beams proved useful in physics research. A notable early example use of an ion source was in the first vacuum mass spectrometer invented by Aston and used to identify elemental isotopes. Ions were extracted from an ion source in which a vacuum arc was formed between two metal electrodes.

Since those early days, ion beams have found application in a variety of industrial applications, most notably, as a technique for introducing dopants into a silicon wafer. While a number of ion sources have been developed for different purposes, the physical methods by which ions can be created are, however, quite limited and, with the exception of a few ion sources exploiting such phenomena as direct sputtering or field emission from a solid or liquid, are restricted to the extraction of ions from an arc or plasma.

The plasma in an ion source is generated by a low-pressure discharge between electrodes, one of which is often a cathode of electron-emitting filaments, excited by direct current, pulsed, or high-frequency fields. An ion implantation apparatus having an ion source utilizing electron emitting filaments as a cathode is disclosed in U.S. Pat. No. 4,714,834 to Shubaly, which is incorporated herein in its entirety by reference. The plasma formed in this way is usually enhanced by shaped static magnetic fields. The active electrodes, particularly the hot filament cathode and the plasma chamber walls which function as the anode are attacked by energetic and chemically active ions and electrons. The lifetime of the ion source is often limited to a few hours by these interactions, especially if the gaseous species introduced into the ion source to form the plasma are in themselves highly reactive, e.g., phosphorous, fluorine, boron, etc.

The increasing use of ion beams in industry (e.g., ion implantation, ion milling and etching) has placed a premium on the development of ion sources having a longer operational life. Compared to filament ion sources, microwave-energized ion sources operate at lower ionization gas pressure in the plasma chamber resulting in higher electron temperatures (eV), a desirable property. However, prior art microwave energy ion sources proved, like the filament ion sources, to have limited operational lives (about two hours) before repair/replacement was required.

U.S. Pat. No. 4,883,968 to Hipple et al., which is incorporated herein in its entirety by reference, discloses one such microwave energized ion source. The Hipple et al. ion source includes a window bounding one end of a cylindrical stainless steel plasma chamber. The window functions as both a microwave energy interface region and a pressure or vacuum seal. As a microwave energy interface region, the window transmits microwave energy from a microwave waveguide to source materials within the plasma chamber. As a vacuum seal, the window provides a pressure seal between the plasma chamber, which is evacuated, and the unevacuated regions of the ion source, e.g., the region through which the waveguide extends. The Hipple et al. window is comprised of a sandwiched, parallel arrangement of three dielectric disks (two being made of boron nitride and the third being alumina) and one quartz disk. A thin boron nitride disk bounds the plasma chamber. Adjacent the thin boron nitride disk is a thicker boron nitride disk followed in order by the alumina disk and finally the quartz disk.

The boron nitride disks exhibit a high melting point and good thermal conductivity. Microwave energy is delivered to the window by a waveguide which extends from a microwave source to a flange adjacent the window's quartz disk. The flange has a central rectangular opening through which microwave energy passes from the waveguide to the window. The quartz disk functions as a vacuum seal to maintain the vacuum drawn in the plasma chamber. The alumina plate serves as an impedance matching plate to tune the microwave energy. Impedance matching is required to minimize undesirable microwave energy reflection by the plasma chamber plasma. While the Hippie et al. ion source represents an improvement over prior art ion sources in terms of a number of operating characteristics including longevity, designing an ion source having a longer operational life continues to be a goal of manufacturers of ion implantation systems.

The microwave window is necessarily exposed to high temperatures present in the plasma chamber (<800° C.). Moreover, the microwave energy interface region must be hot to remain clean and provide acceptable microwave energy coupling between the microwave waveguide and the plasma in the plasma chamber when ionizing source materials which include condensable species such as phosphorous. However, it has been found that the vacuum seal has an increased operating life when it is not subjected to extreme heat or chemical attack from the energized ions and electrons in the plasma.

A hollow tube waveguide was conventionally used in prior art devices to feed microwave energy from the microwave generator to the plasma chamber. The waveguide mode of microwave energy transmission is limited to a range of frequencies. If the generated microwave frequency is outside the range, the waveguide will not transmit the microwave energy, a cut-off condition will result. Transmission frequency range limitations are a disadvantage of the waveguide microwave energy transmission mode.

DISCLOSURE OF THE INVENTION

A microwave energized ion source apparatus constructed in accordance with the present invention includes TEM (transverse electric magnetic) microwave energy transmission to a dielectric plasma chamber defining an interior region and having an open end. The chamber includes a wall portion adapted to receive an enlarged end of the center conductor of a coaxial microwave or RF transmission line. A plasma chamber cap overlies the open end of the plasma chamber and includes an elongated aperture or arc slit through which ions exit the plasma chamber.

The plasma chamber is supported by a plasma chamber housing that supports the plasma chamber in an evacuated region. The coaxial transmission line extends through the evacuated region, thus a pressure or vacuum seal is spaced apart from the energy input to the plasma chamber. The housing includes a heater coil wrapped about a portion of its outer periphery to provide additional heat to the plasma chamber. The ion source apparatus includes one or more heated vaporizers for vaporizing source material elements. Passageways in the plasma chamber housing route vaporized source material elements from respective outlet valves of the vaporizers to the plasma chamber interior region.

The ion source apparatus is supported within a support tube extending into an interior region of an ion source housing. A clamping fixture is coupled to an end of the support tube and includes locating slots which interfit with locating projections on the plasma chamber cap to precisely align the arc slit with a desired predetermined ion beam line.

A microwave energy or RF input operating in the TEM mode (transverse electric magnetic) coupled to the plasma chamber injects energy into the plasma chamber accelerating electrons within the plasma chamber to high energies thereby ionizing a gas routed to the plasma chamber. In the TEM mode, microwave energy is fed to the plasma chamber via a transmission assembly including a center conductor and an overlying coaxial tube. The microwave energy travels through a gap between the conductor air tube. The TEM mode, unlike a waveguide microwave energy transmission mode in which no center conductor is used, does not have frequency range limits, above or below which no energy transmission occurs. Additionally, the TEM mode provides excellent microwave coupling between a microwave generator and the plasma chamber contents. The plasma chamber is supported in an evacuated region and a portion of the microwave energy or RF input extends through an evacuated passageway.

Magnetic field defining structure surrounding the plasma chamber generates a magnetic field within the plasma chamber to control plasma formation within the chamber. The magnetic field defining structure includes a magnet holder and a magnet spacing ring supporting a set of permanent magnets which sets up a magnetic field configuration within the plasma chamber. The magnetic field defining structure facilitates easy conversion between alternate magnetic field configurations, i.e., dipole, hexapole and cusp.

An ion source apparatus constructed in accordance with the present invention includes a vacuum seal that is spaced apart from the wall portion of the plasma chamber which is adapted to receive the coaxial transmission line center conductor. The center conductor engaging wall portion defines a microwave-energy interface region. The vacuum seal, being spaced apart from the interface region, operates at cooler temperatures and away from the chemically active species in the energized plasma resulting in an increased operational life of the vacuum seal. Additionally, the relatively large microwave interface region defined by the area of engagement between the enlarged end of the coaxial transmission microwave waveguide center conductor and the recessed portion of the plasma chamber enhances a microwave energy coupling between the microwave waveguide and the energized plasma. Yet another advantage of the present invention is the ease and rapidity with which the magnetic field configuration within the plasma chamber may be changed in response to varying characteristics of the source materials and source gas used and specific implantation requirements of a workpiece being treated.

This and other objects, advantages and features of the invention will become better understood from a detailed description of a preferred embodiment which is described in conjunction with the accompanying drawings.

DETAILED DESCRIPTION

Figure 1:
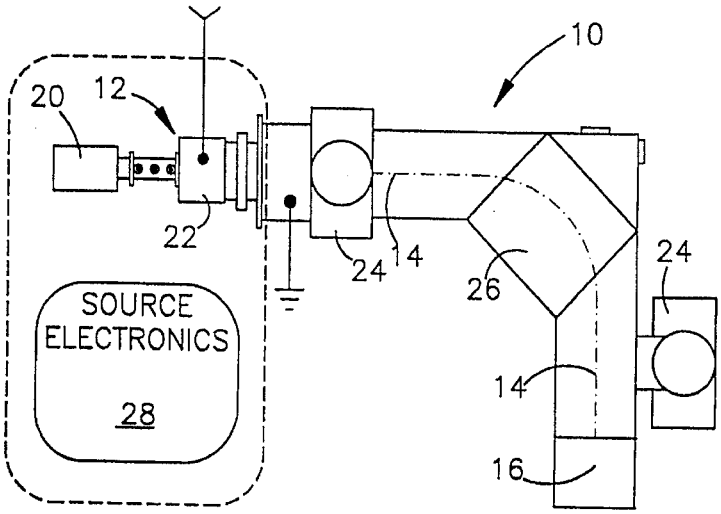
FIG. 1 is a schematic drawing of an ion implantation apparatus including a microwave energized ion source.

Turning now to the drawings, FIG. 1 is a schematic overview depicting an ion implantation system 10 having an ion source apparatus 12 which generates positively charged ions. The ions are extracted from the ion source apparatus 12 to form an ion beam which travels along a fixed beam line or path 14 to an implantation station 16 where the beam impinges on a workpiece (not shown) to be treated. One typical application of such an ion implantation system 10 is to implant ions or dope silicon wafers at the ion implantation station 16 to produce semiconductor wafers.

Control over ion implantation dose is maintained by selective movement of the silicon wafers through the ion beam path 14. One example of a prior art implantation system is the Model No. NV 20A implanter sold commercially by the Eaton Corporation, Semiconductor Equipment Division. This prior art ion implantation system utilizes an ion source comprising electron emitting filaments similar to that disclosed in the '834 patent to Shubaly.

A microwave generator 20 (shown schematically in FIG. 1) transmits microwave energy to the ion source apparatus 12. The preferred microwave generator 20 is a Model No. S-1000 generator sold commercially by American Science and Technology, Inc. A portion of the ion source apparatus 12 is disposed within an evacuated portion of an ion source housing assembly 22. Ions exiting the ion source apparatus 12 are accelerated by an extraction electrode assembly (not shown) disposed within an ion source housing 22 and enter the beam line or path 14 that is evacuated by two vacuum pumps 24. The ions follow the beam path 14 to an analyzing magnet 26 which bends the ion beam and redirects the charged ions toward the implantation station 16. Ions having multiple charges and/or different species ions having the wrong atomic number are removed from the beam due to ion interaction with the magnetic field set up by the analyzing magnet 26. Ions traversing the region between the analyzing magnet 26 and the implantation station 16 are accelerated to even higher energies by additional electrodes (not shown) before impacting wafers at the implantation station 16.

Control electronics 28 (shown schematically in FIG. 1) monitor the implantation dose reaching the implantation station 16 and increase or decrease the ion beam concentration based upon a desired doping level for the silicon wafers. Techniques for monitoring beam dose are known in the prior art and typically utilize a Faraday Cup (not shown) to monitor beam dose. The Faraday Cup selectively intersects the ion beam path 14 before it enters the implantation station 16.

Figure 3:
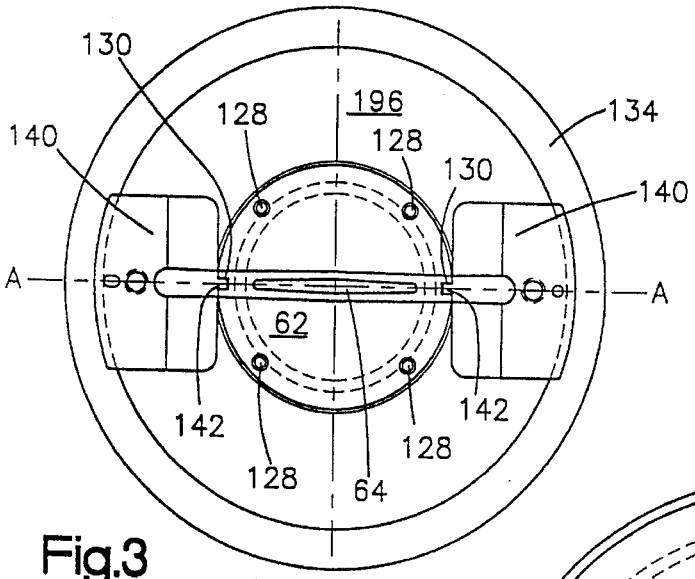
FIG. 3 is a side elevation view of the ion source apparatus of FIGS. 2A–2B as seen from the plane indicated by line 3—3 in FIG. 2B.
Figure 4:
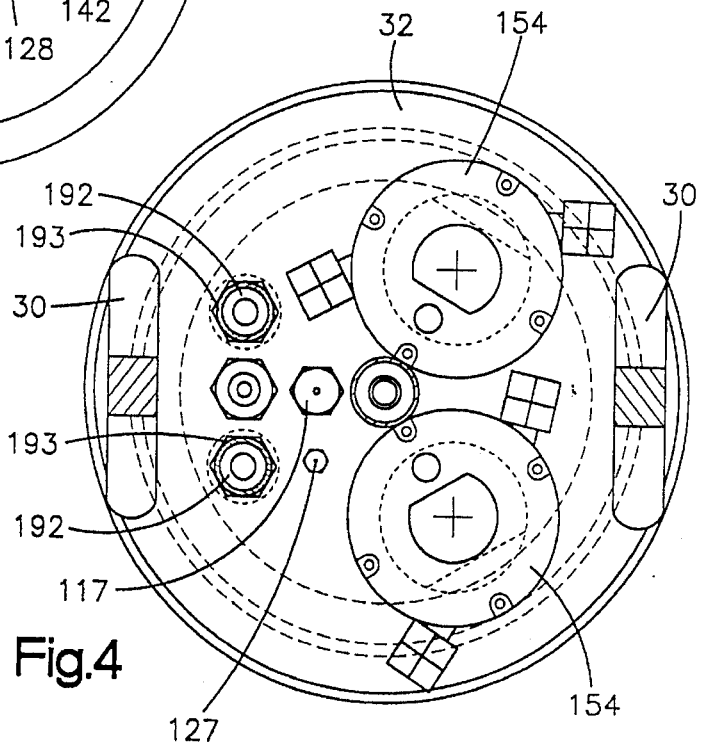
FIG. 4 is a side elevation view of the ion source apparatus of FIG. 2A–2B as seen from the plane indicated by line 4—4 in FIG. 2B.
Figure 2A:
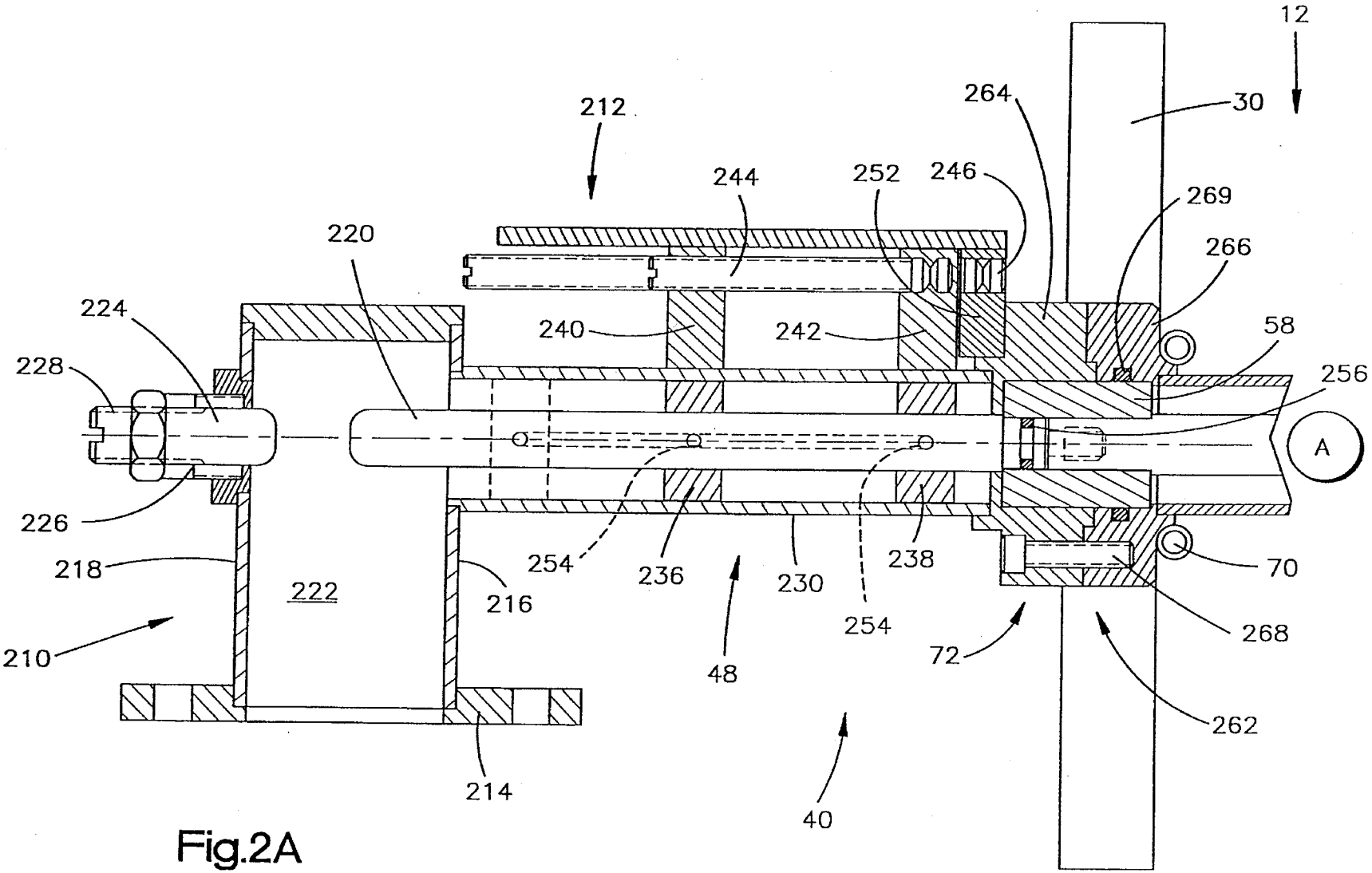
FIGS. 2A and 2B are an enlarged section view of an ion source apparatus constructed in accordance with the invention supported within a support tube.

Turning to FIGS. 2A, 3B, and 4, the ion source apparatus of the present invention, shown generally at 12, utilizes microwave energy in lieu of electron emitting filaments to generate positively charged ions. While the description of the preferred embodiment contemplates the use of microwave signals to generate the ions, it should be understood that, alternately, RF signals may be used to generate the ions and as such fall within the scope of the invention. The ion source apparatus 12 is an interconnected assembly which, when disconnected from the microwave generator 20 and the ion source housing assembly 22, can be moved about using a pair of bakelite handles 30 (one of which can be seen in FIG. 2A and both of which can be seen in transverse section in FIG. 4) which extend from an outer face 32 of an annular ion source apparatus mounting flange 34.

The apparatus 12 includes a microwave tuning and transmission assembly, shown generally at 40, an ionization or plasma chamber 42, a pair of vaporizers 44 and a magnetic field generating assembly 46 surrounding the plasma chamber 42. The microwave tuning and transmission assembly 40 includes a tuner assembly 48 for adjusting the impedance of the microwave energy supplied by the microwave generator 20 to match the impedance of the energized plasma in an interior region 50 of the plasma chamber 42. The magnetic field generating assembly 46 is used to generate a magnetic field in the plasma chamber interior region 50 which produces an electron cyclotron resonance frequency condition in the plasma chamber 42. At the electron cyclotron resonance frequency, free electrons in the plasma chamber interior region 50 are energized to levels up to ten times greater than the energy levels in conventional plasma discharge and facilitates striking an arc in the interior region.

The microwave tuning and transmission assembly 40 also includes a microwave energy transmission assembly 52 which transmits the tuned microwave energy to the plasma chamber 42 in the TEM (transverse electric magnetic) mode of transmitting microwave energy. The microwave energy transmission assembly 52 includes a coaxial transmission line center conductor 54 centrally disposed within a coaxial tube 56. Preferably, the center conductor 54 is comprised of molybdenum, while the coaxial tube 56 is comprised of silver-plated brass. Surrounding a coupling of the tuner assembly 48 and the microwave energy transmission assembly 52 is a pressure or vacuum seal 58 separating non-vacuum and vacuum portions of the ion source apparatus 12. The microwave energy transmission assembly coaxial tube 56 is evacuated as is an interior cavity 57 defined by the ion source housing assembly 22 and the ion source apparatus mounting flange 34. The microwave energy transmitted by the center conductor 54, therefore passes through an evacuated region en route to the plasma chamber 42. A portion of the microwave energy transmission assembly 52 extends through a central opening of the ion source apparatus mounting flange 34. The coaxial tube 56 is soldered to the ion source apparatus mounting flange 34. The remaining components of the ion source apparatus 12 are supported by the mounting flange 34 and the portion of the coaxial tube 56 extending beyond an inner face 60 of the mounting flange 34, as will be described.

The plasma chamber 42, comprised of a dielectric material transparent to microwave energy, includes an open end overlied by a plasma chamber cap 62 having an elongated aperture or arc slit 64. Vaporized source materials and a source gas are introduced to the plasma chamber interior region 50 through three apertures 63 in a closed end 65 of the plasma chamber, opposite the open end. The closed end of the plasma chamber includes a cylindrical portion having a recess adapted to receive an enlarged distal end portion 66 of the center conductor 54 and forms a microwave energy interface region 68 through which the microwave energy passes to energize the vaporized source materials and source gas in the plasma chamber interior region 50. The vacuum seal 58 is spaced apart from the microwave seal 68, the vacuum seal and interface region being at opposite ends of the center conductor 54. As a result of the separation of the interface region 68 and the vacuum seal 58, the vacuum seal 58 functions under relatively cool conditions, away from the intense heat of the plasma chamber. Additionally, as will be described, the vacuum seal 58 is cooled by a water cooling tube 70 disposed adjacent a flange assembly 72 supporting the seal. Additionally, the vacuum seal 58 is isolated from chemical attack by the energized plasma in the plasma chamber interior region 50. The relatively cool operating conditions and protection from chemical attack will result in a longer operational life for the vacuum seal 58 and, thereby, increase the expected mean time between failures of the ion source apparatus 12. A surface of the cap 62 facing the plasma chamber interior region 50 is coated with inert material over all but a small portion bordering the arc slit 64. The coating protects the cap 62 from chemical attack by the energized plasma.

The microwave energy transmitted to the plasma chamber 42 by the transmission assembly 52 passes through the microwave interface region 68 and into the plasma chamber interior region 50. The microwave energy causes the gas molecules in the interior region 50 to ionize. The generated ions exit the plasma chamber interior region 50 through the arc slit 64 in the plasma chamber cap 62. The plasma chamber 42 fits within and is supported by a plasma chamber housing 74. The housing 74 includes a heater coil 76 which provides additional heat to the source materials in the plasma chamber interior region 50. The plasma chamber housing 74 in turn is coupled to and supported by a distal end of the microwave energy transmission assembly coaxial tube 56.

The magnetic field generating member 46 surrounds the plasma chamber 42 and includes an annular magnet holder 78 and a magnet spacing ring 80 which support and orient a set of permanent magnets 82. The set of magnets 82 set up magnetic field lines which pass through the plasma chamber interior region 50. Ions which are generated in the plasma chamber interior region 50 drift in spiralling orbits about the magnetic field lines. By properly axially aligning the magnetic field within the plasma chamber interior region 50 with the cap arc slit 64, a greater proportion of the generated ions will be made available for extraction through the arc slit 64. Additionally, by adjusting the set of permanent magnets 82 such that the magnetic field is strongest (approximately 875 Gauss) adjacent the plasma chamber interior walls and weaker near a center of the chamber interior region 50, the frequency of free electron and ion collisions with the plasma chamber interior walls will be reduced. Electron and ion collisions with the plasma chamber interior walls result in inefficient utilization to the microwave energy supplied to the plasma chamber 42. The strength of the magnetic field in the plasma chamber interior region 50 is varied to create the electron cyclotron resonance frequency condition in the plasma chamber interior region 50 thereby energizing the free electrons in the chamber 42 to greater energy levels.

When subjected to microwave energy and heat, the source materials injected into the plasma chamber interior region 50 form a gaseous ionizing plasma. The microwave energy also excites free electrons in the plasma chamber interior region 50 which collide with gas molecules in the plasma generating positively charged ions and additional free electrons which in turn collide with other gas molecules. The source materials routed to the plasma chamber interior region include one or more source elements, which are vaporized by the pair of vaporizers 44 before being routed to the plasma chamber interior region 50. The element(s) chosen for vaporization may include phosphorous (P), arsenic (As) and antimony (Sb). As will be described, the source material element(s) are loaded into the vaporizers 44 in solid form. Each vaporizer 44 includes a heater coil 84 which subject the source element(s) to intense heat (<500° C.) causing vaporization. The vaporized element(s) exit the vaporizer 44 through a spring loaded gas seal 86 at a distal end of the vaporizer and is routed to the plasma chamber interior region 50. The vaporized element(s) pass through a passageway 88 bored in the plasma chamber housing and exit into the plasma chamber interior region 50 via a gas nozzle 90 which extends through an aperture in the plasma chamber 42.

An extraction electrode assembly (not shown) is mounted through the access opening (not shown) in the ion source housing assembly 22 adjacent a first end 92 of a hollow support tube 94 extending within the interior cavity 57 defined by the ion source assembly housing 22 and the ion source apparatus mounting flange 34. The extraction electrode assembly includes spaced apart disk halves which are energized to accelerate the ions exiting the plasma chamber cap arc slit 64 along the beam path 14. Ions exiting the ion source assembly housing 22 have an initial energy (40–50 kev, for example) provided by the extraction electrode assembly. Control over the accelerating potentials and microwave energy generation is maintained by the source control electronics 28, schematically depicted in FIG. 1.

Figure 2B:
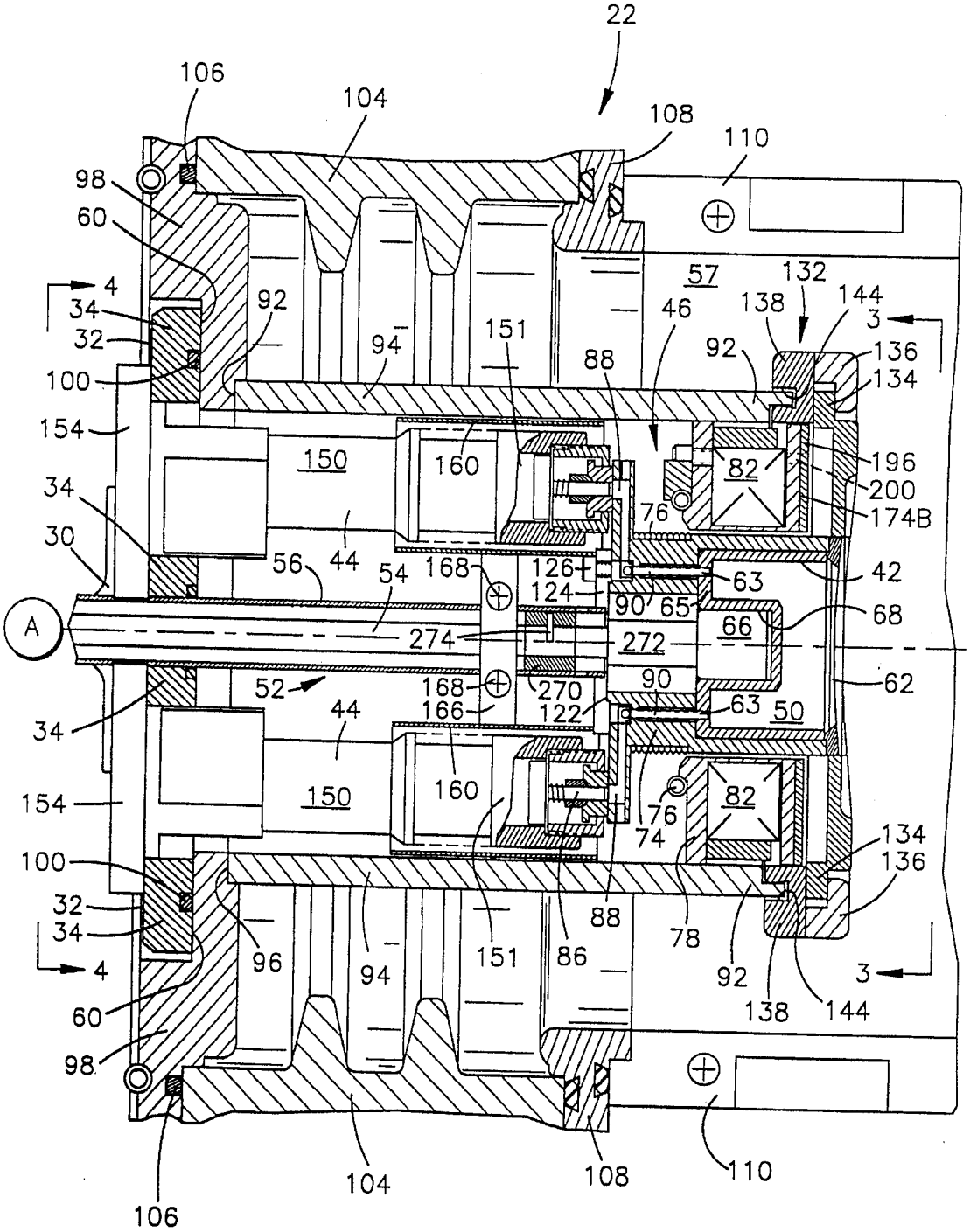

As can best be seen in FIG. 2B, a portion of the ion source apparatus 12 extends beyond the ion source apparatus mounting flange inner face 60. This portion includes the plasma chamber 42 and cap 62, the pair of vaporizers 44, the magnetic field generating assembly 46 and a portion of the microwave energy transmission assembly 52 and is adapted to slide into a second end 96 of the hollow support tube 94. Extending from the support tube second end 96 is a support tube flange 98. The ion source apparatus mounting flange 34 is coupled to the support tube flange 98 and an O-ring 100 disposed in an annular groove in the mounting flange inner face 60 insures a positive air-tight seal between the mounting flange 34 and the support tube flange 98. The support tube flange 98 in turn is secured by bolts (not shown) to an end of an insulator 104 which is part of the ion source housing assembly 22. An O-ring 106 disposed in an annular groove in the support tube flange inner face 60 sealingly engages an outer face of the insulator 104. The support tube 94 extends from the support tube flange 98 into the ion source housing assembly interior cavity 57. The ion source housing assembly includes the insulator 104 which is coupled to an interface plate 108 which in turn is coupled to an ion source housing 110. The source housing 110 includes an access opening (not shown) permitting access to the ion source housing assembly interior cavity 57 and the support tube first end 92.

The plasma chamber 42 is comprised of a dielectric material, such as boron nitrite, which is transparent to microwave energy. In addition to its dielectric properties, boron nitrite also has excellent thermal conductivity and a high melting point which is desirable since the plasma chamber 42 operates most efficiently at temperatures in excess of 800° C. Alumina may, alternatively, be used. The chamber 42 is cup-shaped with one open end and one closed end 65. The recessed or indented portion is centered with respect to the closed end 65 of the plasma chamber 42 and forms the microwave energy interface region 68 through which microwave energy from the center conductor enlarged distal end 66 passes to the plasma chamber interior region 50.

The shape of the plasma chamber 42 provides a number of advantages. The microwave energy interface region 68 formed by the recessed portion of the closed end 65 of the plasma chamber 42 has a larger area of contact with the microwave energy transmission line center conductor 54 as compared to a nonrecessed plasma chamber design. The large size of the microwave interface region 68 provides for excellent microwave energy transfer characteristics between the center conductor 54 and the plasma chamber interior region 50. Further, since the recessed portion is centered with respect to the plasma chamber closed end 65, the distances between the center conductor 54 and points within the plasma chamber interior region 50 are reduced as compared to the non-recessed plasma chamber design. The reduction in distance between the microwave energy transmission line center conductor 54 and points within the interior region 50 results in a more even distribution of microwave energy through the energized plasma. Additionally, the plasma chamber 42 provides for separation between the center conductor 54 and the energized plasma in the plasma chamber interior region 50. The separation protects the center conductor enlarged distal end portion 66 from chemical etching that would occur if the center conductor distal end portion were in direct contact with the plasma.

Figure 5:
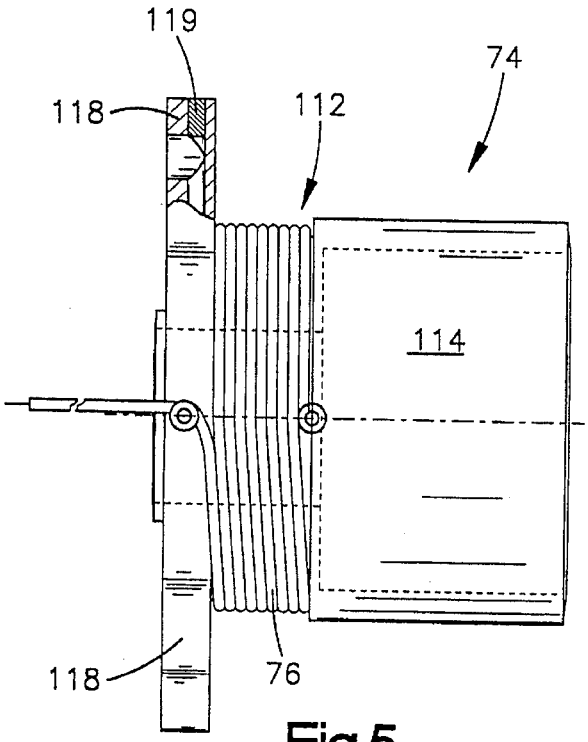
FIG. 5 is a front elevation view of a plasma chamber housing of the ion source apparatus of FIGS. 2A–2B.
Figure 6:
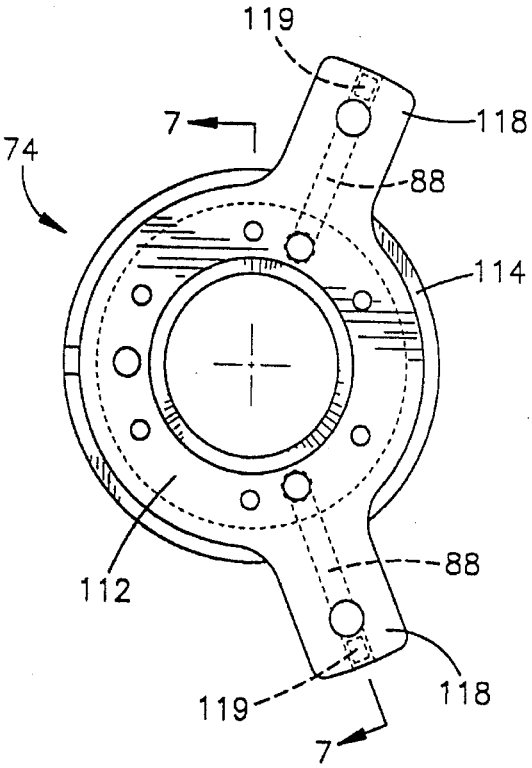
FIG. 6 is a bottom view of the plasma chamber housing of FIG. 5.
Figure 7:
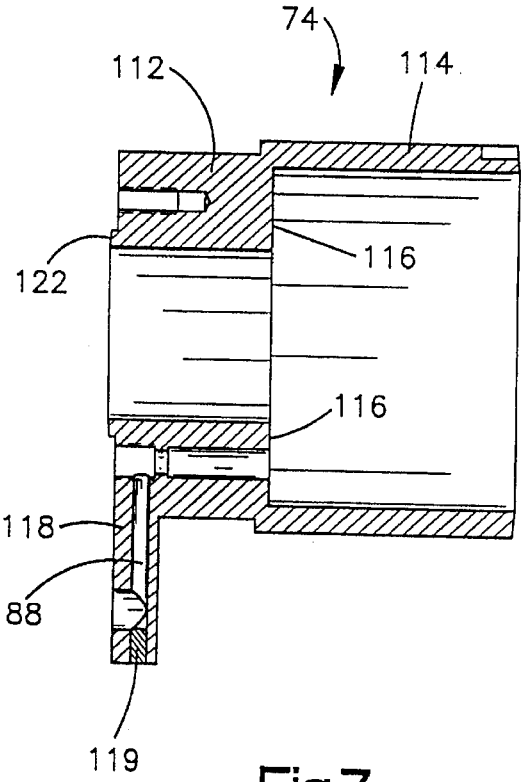
FIG. 7 is a sectional view of the plasma chamber housing of FIG. 5 as seen from the plane indicated by line 7—7 in FIG. 6.
Figure 9:
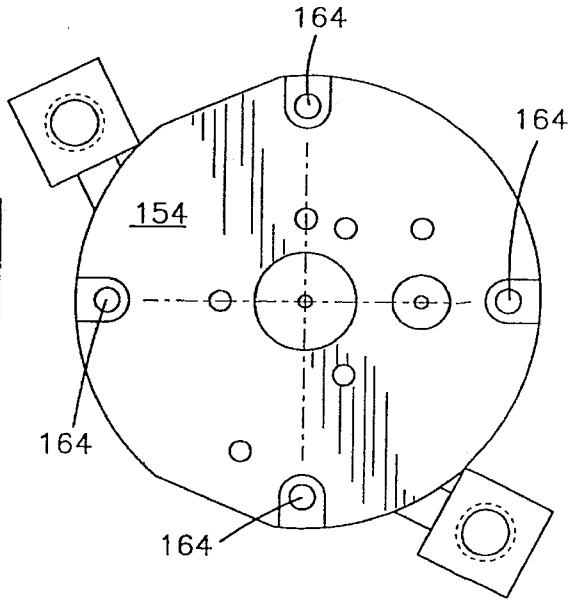
FIG. 9 is an end view of the vaporizer as seen from the plane indicated by line 9—9 in FIG. 8.
Figure 8:
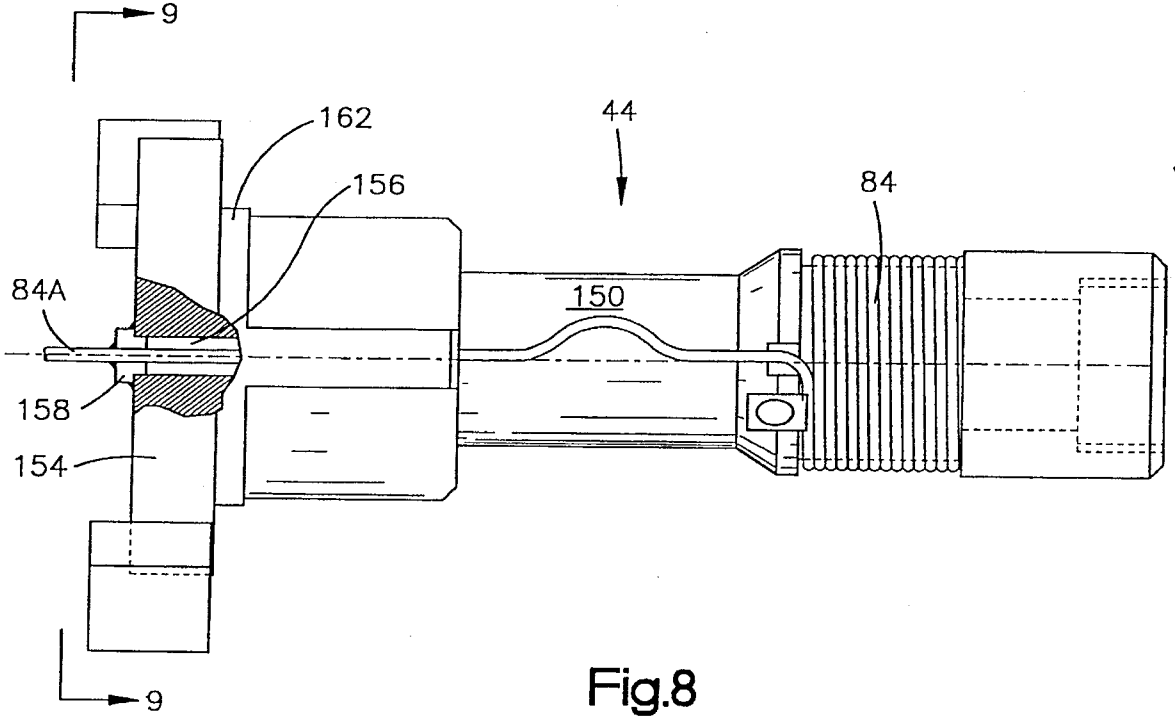
FIG. 8 is a side elevation view of a vaporizer of the ion source apparatus of FIGS. 2A–2B.

The plasma chamber 42 fits into and is supported by the plasma chamber housing 74 having an annular base portion 112 and a slightly larger second annular portion 114 extending from the base portion. The second annular portion 114 defines a cylindrical interior region sized to fit the plasma chamber. The annular base portion has a slightly smaller internal diameter resulting in a radially inwardly stepped portion or shoulder 116 which provides a support for the closed end 65 of the plasma chamber. As can best be seen in FIGS. 5–7, the plasma chamber housing annular base portion 112 includes two radially outwardly extending projections 118. Holes are bored through the projections 118 and the annular base portion 112 to form right angled passageways 88 permitting fluid communication between each vaporizer gas seal 86 and the plasma chamber interior region 50. The two gas nozzles 90 each disposed in a respective passageway 88 extend into two of the apertures 63 in the plasma chamber closed end 65. Dowel pins 119 are press fit into an end portion of each section of passageway 88 disposed in the respective projections 118 to prevent escape of the vaporized source materials through the passageway end portions.

The annular base portion 112 further includes the heating coil 76 which is brazed to its outer periphery. The heating coil 76 transfers heat to the plasma chamber interior region 50. The plasma chamber interior region 50 is also heated by the microwave energized plasma. The additional heat provided by the heating coil 76 has been found necessary to insure sufficiently high temperature levels (<800° C.) in the plasma chamber interior region 50, particularly when running the ion source apparatus 12 at low power levels. An end 122 of the annular base portion 112 includes an annular stepped portion (best seen in FIGS. 2B and 7) which interfits with a recessed portion of a flange 124 soldered to the distal end of the microwave energy transmission line coaxial tube 56. The plasma chamber housing 74 is secured to the flange 124 by six bolts 126, one of which can be seen in FIG. 2B, extending through the flange 124 and into the annular base portion 112.

A temperature measuring thermocouple (not shown) is inserted into a hole bored into the plasma chamber housing 74. The thermocouple exits the ion source apparatus 12 through a fitting 127 disposed in the ion source apparatus mounting flange 34.

A source gas inlet nozzle (not shown) fits into the third aperture (not shown) in the plasma chamber closed end 65 and is connected via a gas tube (not shown) to a fitting 117 (seen in FIG. 3) disposed in the ion source apparatus mounting flange 34. An external gas supply (for example, oxygen gas if oxygen ions are desired) is coupled to the fitting 117 to supply source gas to the plasma chamber interior region 50. The gas tube extends through an aperture (not shown) in the flange 124 soldered to the distal end of the waveguide coaxial tube 56.

The plasma chamber cap 62 overlies and sealingly engages the open end of plasma chamber 42. The cap 62 is secured to an end of the plasma chamber housing 74 using four temperature resistant tantalum screws 128. The cap 62 includes two slots 130 milled into an outer periphery of the cap. The locating slots 130 are precisely aligned with a longitudinal axis A—A bisecting the arc slit 64. The locating slots 130 facilitate alignment of the arc slit 64 with a predetermined or desired ion beam line and maintain that alignment in spite of axial movement of the plasma chamber 42 within the support tube 94 caused by the expansion of the ion source apparatus components which will occur due to heat when the ion implantation system 10 is operating.

A self-centering split ring clamping assembly 132 is secured to the first end 92 of the support tube 94. The clamping assembly 132 includes a support ring 134 secured between a retainer ring 136 and a split ring 138. The split ring 138 is split along a radius and includes an adjustment screw (not shown) bridging the split. By appropriately turning the adjustment screw, a diameter of the split ring 138 can be increased or decreased. Initially, bolts (not shown) coupling the split ring 138 and the retainer ring 136 are loosely fastened so that the support ring 134 can slide transversely within the confines of split and retainer rings 138, 136. The support ring 134 includes two tab portions 140 each having a locating pin 142 extending radially inwardly from an inner peripheral edge. The split ring 138 also has an annular groove 144 on a vertical face opposite a face adjacent the support and retainer rings 134, 136.

Utilizing an alignment fixture (not shown), the support ring tabs 140 are aligned and secured to a mounting surface of the fixture thereby securing the clamping assembly 132 to the fixture. The fixture is mounted to the ion source housing 110 and extends through the source housing access opening. The fixture is dimensioned such that the split ring groove 144 slips over the first end 92 of the support tube 94 and the tab locating pins 142 are in precise alignment with the predetermined ion beam line. The split ring adjusting screw is turned to increase the diameter of the split ring 138 urging the split ring groove 144 against the support tube first end 92 and thereby securing the clamping assembly 132 to the support tube 94.

Since the support ring 134 is slidable transversely with respect to the split ring 138 and retaining ring 136 and the support ring tabs 140 remain secured to the alignment fixture, the alignment of the locating pins 142 with the predetermined beam line is maintained while the split ring 138 is secured to the support tube first end 92. The bolts coupling the split ring 138 and the retainer ring 136 are then tightened so as to secure the support ring 134 in place while retaining the alignment of the tab locating pins 142 and the predetermined beam line. The alignment fixture is disengaged from the support ring tabs 140 and the fixture is removed from the ion source housing 110.

Grasping the ion source apparatus handles 30, the ion source apparatus 12 is inserted into the support tube second end 96, the handles are used to rotate the source apparatus 12 such that the plasma chamber housing cap locating slots 130 align with and slideably interfit with the support ring tab locating pins 142 thereby insuring proper alignment of the arc slit 64 with the predetermined beam line. The ion source apparatus mounting flange 34 is then coupled to the support tube flange 98 to secure the ion source apparatus 12. Finally, the microwave generator 20 is coupled to the tuner assembly 48 and the ion source apparatus 12 is ready for operation. During operation, the ion source components including the transmission assembly 52 heat up and expand. Since the microwave energy transmission line coaxial tube 56 is welded to the ion source apparatus mounting flange 34 which in turn is coupled to the ion source housing assembly 22, the axial expansion of the coaxial tube tends to move the plasma chamber 42 axially toward the support tube first end 92 (that is, to the right in FIG. 2B). The locating pins 142 of the support ring tab portions 140 have sufficient length in the axial direction (that is, in a direction parallel to the support tube central axis and the predetermined beam line) such that the pins continue to engage and interfit with the cap locating slots 130 in spite of the heat induced axial movement of the plasma chamber 42. The continued engagement of the tab portion locating pins 142 with the cap locating slots 130 insures proper alignment of the arc slit 64 with the predetermined beam line at all times.

The pair of vaporizers 44 are identical in structure and function. Therefore, for ease of presentation, only one vaporizer will be discussed, but the description will be applicable to both vaporizers. The vaporizer 44 is a generally cylindrical structure that can be extracted from the ion source apparatus 12 for servicing the vaporizer 44 or adding source materials to the vaporizer without the necessity of removing the ion source apparatus 12 from the support tube 94. The vaporizer 44 includes the spring-loaded gas seal assembly 86 at a distal end (that is, the end closest to the plasma chamber 42), a cylindrical body 150 defining an interior cavity 151 into which source materials are deposited, the heater coil 84 which is brazed to a reduced diameter portion of the body 150 and a vaporizer cap 154 adapted to be secured to the ion source apparatus mounting flange outer face 32. The gas seal assembly 86 includes a threaded outer peripheral surface which threads into corresponding internal threads at a distal end of the body 150. Removal of the gas seal assembly 86 from the body 150 permits source materials to be introduced to the body interior cavity for vaporization. The high temperature required for vaporization of the source elements (approximately 500° C. to avoid condensation for species such as P, As or Sb) is provided by the heater coil 84. The heater coil 84 is energized by a power source (not shown) external to the ion source apparatus 12. An extension of the heater coil exits the ion source apparatus 12 through an aperture 156 in the vaporizer cap 154. A sealing member 158 is brazed to a straight portion 84A of the heater coil 84 extending through an outer face of the vaporizer cap 154 adjacent the aperture 156 to form a vacuum tight seal surrounding the protruding straight portions 84A of the heater coil 84. (Recall that the interior cavity 57 defined by the ion source housing assembly 22 and the ion source apparatus mounting flange 34 and the microwave energy transmission assembly 52 are evacuated, while the areas outside the ion source housing are generally not evacuated.) The vaporizer is inserted through an aperture in the ion source apparatus mounting flange 34. A distal portion of the vaporizer fits into an open-ended stainless steel cylindrical heat shield 160 which functions both as a heat shield and as a guide to properly align the gas seal assembly 86 with the plasma chamber housing passageway 88 leading to the plasma chamber interior region 50. An enlarged outer diameter portion 162 of the body 150 fits snugly into the aperture in the ion source apparatus mounting flange 34 and four bolts 164 secure the vaporizer cap 154 to the ion source apparatus mounting flange outer face 32.

The stainless steel cylindrical heat shields 160 (one for each vaporizer 44) are precisely positioned with respect to the waveguide coaxial center tube 56. The heat shields 160 are welded to respective ends of a flat metal piece 166 approximately ⅛" thick. The metal piece, in turn is secured via two screws 168 to a split clamp (not shown) affixed to the waveguide coaxial tube 56.

Turning to FIGS. 10–17, the magnetic field generating assembly 46 sets up a magnetic field within the plasma chamber interior region 50. The magnetic field serves at least three beneficial functions; a) the electrons align themselves in spiralling orbits about the magnetic lines, if the magnetic lines are axially aligned with the cap arc slit 64, an increased number of generated ions will be extracted through the arc slit; b) a strong magnetic field (875 Gauss) adjacent the plasma chamber interior walls reduces the frequency of electron collisions with walls thereby reducing loss of plasma resulting from such collisions; and c) the magnetic field strength may be manipulated to match the electron cyclotron resonance frequency which increases the free electron energy in the plasma chamber interior region 50 as described previously.

Research has shown that specific ion implantation conditions and source materials dictate the use of different magnetic field configurations within the plasma chamber interior region 50 to obtain optimal results. For example, under certain implantation conditions, high electron energy has been determined to be an important characteristic in achieving good implantation results. A dipole magnetic field configuration, produced by the set of magnets 82 in the orientation seen in FIG. 15, has been found empirically to generate the highest electron temperatures in the plasma chamber interior region 50. Under other conditions, a hexapole magnetic field configuration, produced by the set of magnets 82 in the orientation seen in FIG. 16, or a cusp magnetic field configuration, produced by the set of magnets 82 in the orientation seen in FIG. 17, will be employed to achieve satisfactory implantation results.

The configuration of the magnetic field in the plasma chamber interior region 50 is dependent on the number and orientation of the permanent magnets. The magnetic field generating assembly 46 of the present invention permits rapid conversion between various magnetic field configurations, e.g., dipole, hexapole and cusp, as will be described.

Figure 13:
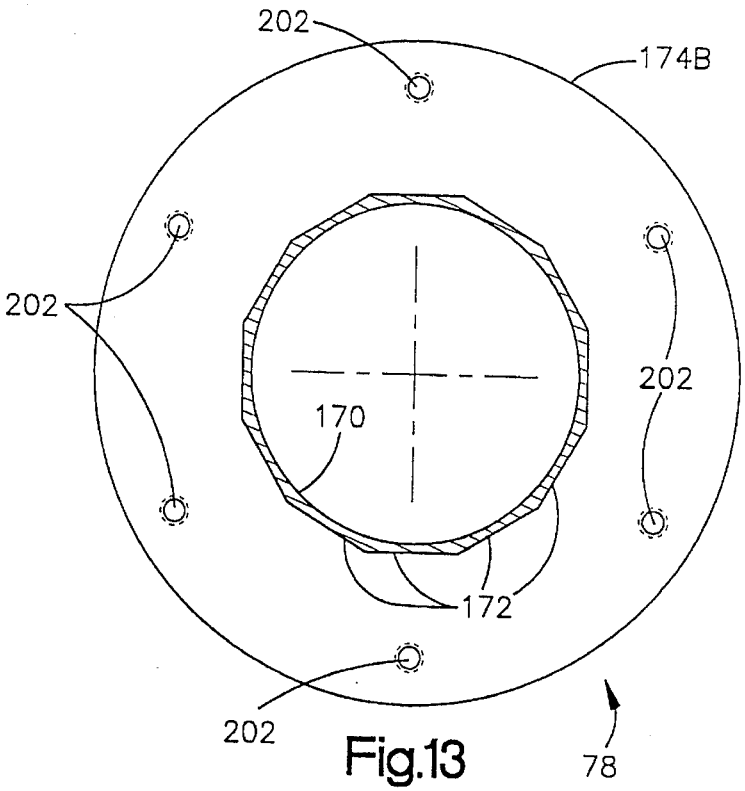
FIG. 13 is a transverse sectional view of the magnet holder of FIG. 10 as seen from the plane indicated by line 13—13 in FIG. 11.
Figure 14:
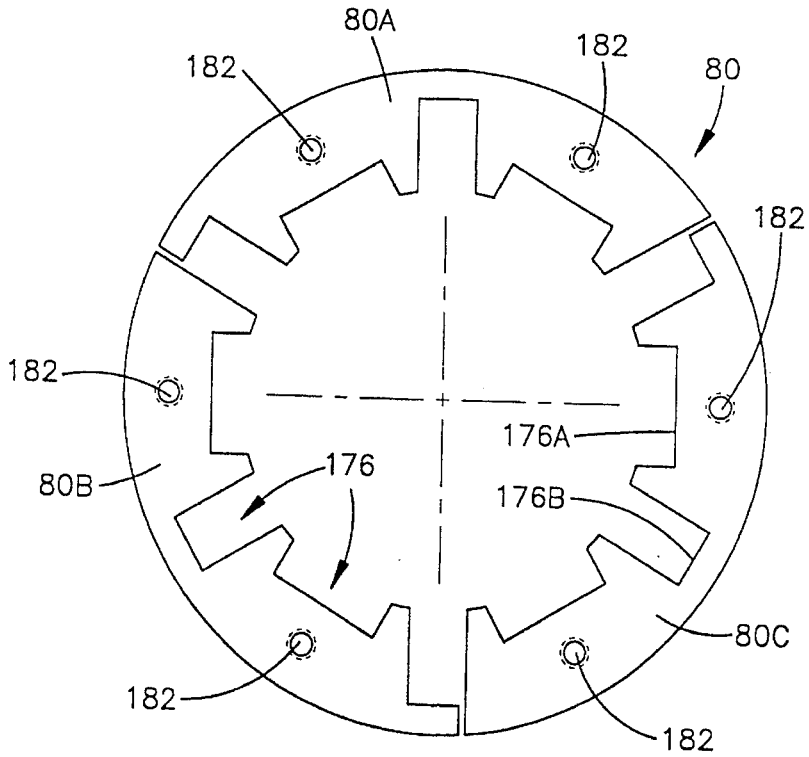
FIG. 14 is a front elevation view of a magnet spacing ring of the magnetic field generating structure of the ion source apparatus of FIGS. 2A–2B.

In any of the configurations, the set of permanent magnets 82 is disposed radially outwardly of the plasma chamber 42 by the annular magnet holder 78 and the magnet spacing ring 80, both of which are comprised of aluminum. As can be seen in FIGS. 10–13, the magnet holder 78 includes a ring portion 170 surrounding an open central area. The open central area is large enough to slip over an outer diameter of the plasma chamber 42. An outer peripheral surface of the ring portion 170 includes twelve symmetrical flats 172. Two parallel extensions 174A, 174B extend radially outwardly from opposite ends of the ring portion 170. The extensions 174A, 174B are preferably 1" apart. Turning to FIG. 14, the magnet spacing ring 80 is composed of three identical truncated triangular sections 80A, 80B, 80C, with each section subtending an arc of 120 degrees. A width of each section 80A, 80B, 80C is 1" so that the sections snugly interfit between the parallel extensions 174A, 174B of the ring portion 170. The individual magnets comprising the set of magnets 82 are preferably 1"×1"×½". Each spacing ring section 80A, 80B, 80C includes four slots 176 along its inner periphery. For the hexapole magnetic field configuration, the slots 176 alternate between two orientations or shapes, a "flat" shape 176A and an "edge" shape 176B (as shown in FIG. 14). In a "flat" shaped slot 176A, a magnet positioned such that a 1"×1" surface of the magnet contacts an inner surface 178A of the slot. While in an "edge" shaped slot, a magnet is positioned such that a 1"×½" or edge surface of the magnet contacts an inner surface 178B of the slot. The total number of slots 176 defined by the three spacing ring sections 80A, 80B, 80C is twelve, matching the number of flats 172 on the ring portion 170. Individual magnets are inserted into appropriate slots of the spacing ring sections 80A, 80B, 80C and are bonded in place using an epoxy resin. The magnet spacing ring sections are then inserted between the ring portions extensions 174A, 174B such that a surface of each magnet is in flush contact with a corresponding ring portion flat 172. The spacing ring sections 80A, 80B, 80C are secured in place by six screws (not shown) which pass through apertures 180 (seen in FIG. 10) in the ring portion extension 174A, and fasten into corresponding apertures 182 in the magnet spacing ring sections.

A second magnet spacing ring (not shown) having twelve "flat" oriented or shaped slots is used for the dipole and cusp configurations. This ring is comprised of two semicircular pieces as opposed to the three piece ring construction shown in FIG. 14, and has six "flat" slots in each semicircular piece.

Figure 15:
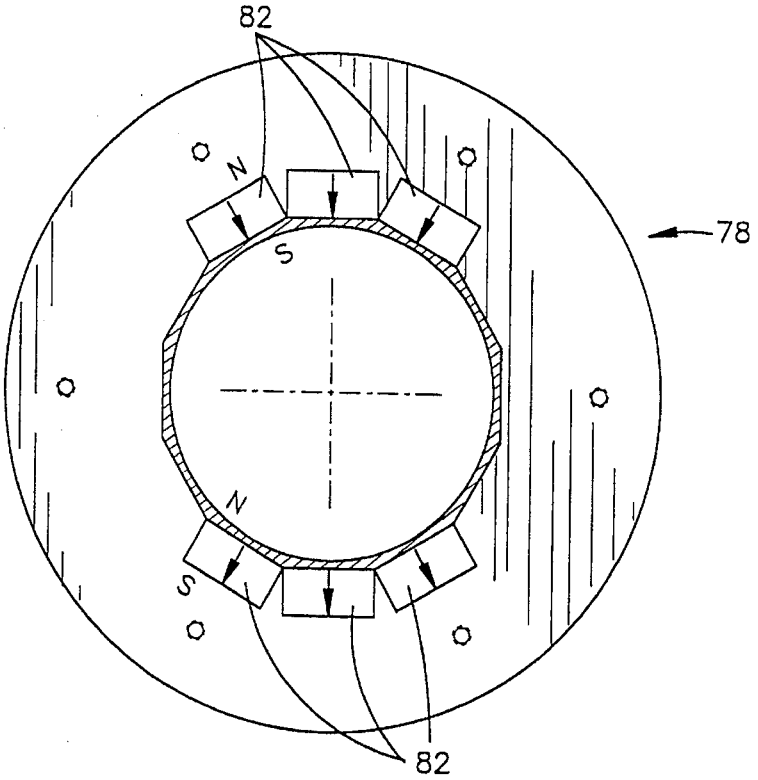
FIG. 15 is a transverse sectional view of the magnet holder of FIG. 10 including a set of permanent magnets disposed in a dipole configuration.

For each magnetic field configuration different spacing ring sections and sets of magnets are used. In a dipole magnetic field configuration, the set of magnets 82 comprises six magnets, as can be seen in FIG. 15, three of which are disposed in adjacent "flat" slots and the remaining three magnets disposed on an opposite side of the magnet spacing ring. The second magnet spacing ring (not shown) having twelve "flat" shaped slots is used. (Note that the illustrations of FIG. 15–17 for ease of depiction do not show the magnet spacing ring sections.) The remaining six slots of the magnet spacing ring 80 are left empty.

Figure 16:
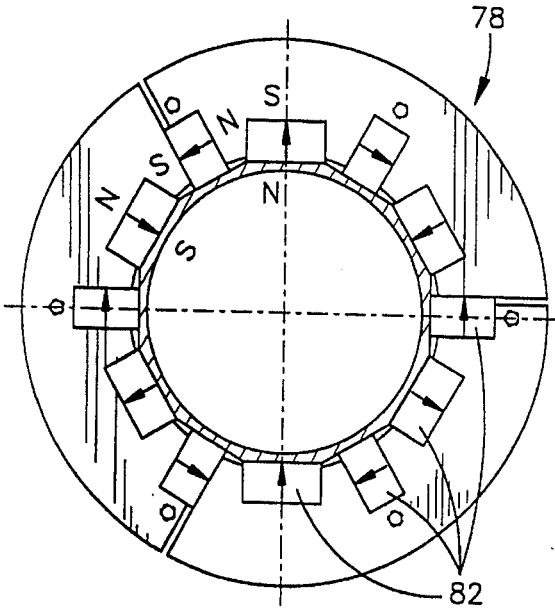
FIG. 16 is a transverse sectional view of the magnet holder of FIG. 10 including a set of permanent magnets disposed in a hexapole configuration.
Figure 17:
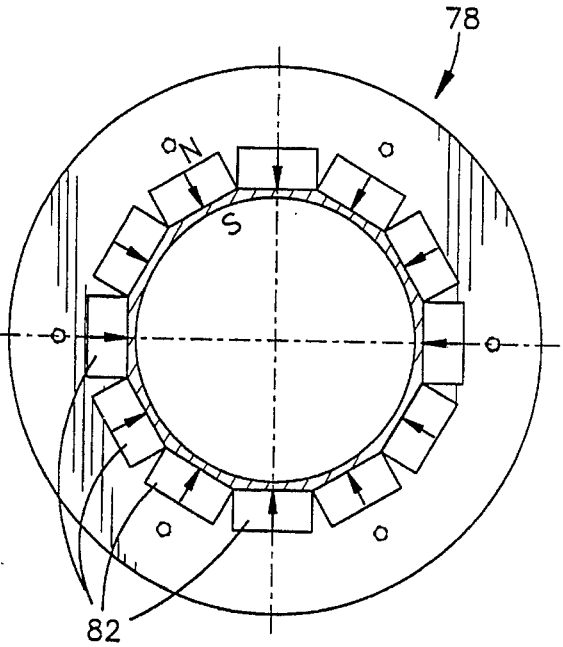
FIG. 17 is a transverse sectional view of the magnet holder of FIG. 10 including a set of permanent magnets disposed in a cusp configuration.

Turning to FIG. 16, in the hexapole magnetic field configuration, the set of magnets 82 comprises twelve magnets which are inserted in all twelve slots of the magnet spacing ring sections. The magnet spacing ring shown in FIG. 14 is employed in the hexapole configuration, that is, the slots 176 alternate between "flat" slots 176A and "edge" slots 176B.

In the cusp magnetic field configuration (FIG. 17), the second magnet spacing ring (not shown) is used and all twelve "flat" slots are filled as shown.

To change the magnet configuration, it is only necessary to remove the screws extending through apertures 180 of the magnet holder 78 into the aligned apertures 182 of the magnet spacing ring sections 80A, 80B, 80C and dislodge the spacing ring sections from between the ring portion parallel extensions 174A, 174B. The spacing ring sections for the desired configuration would then be inserted between the extensions and secured thereto.

Figure 11:
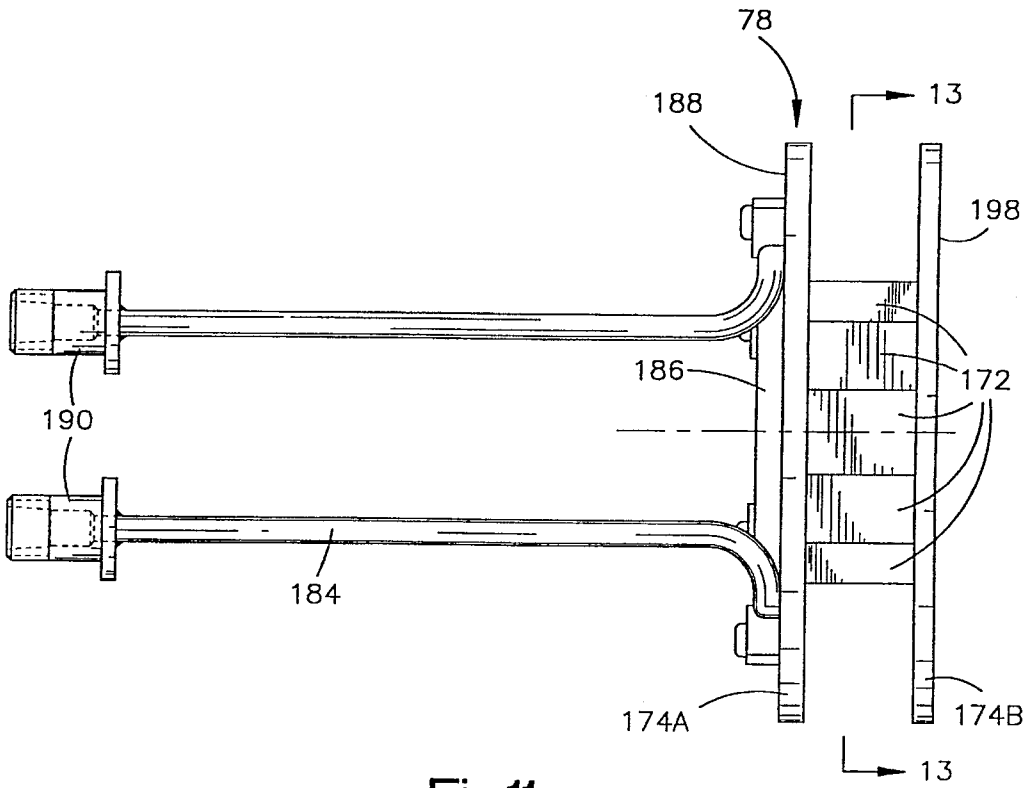
FIG. 11 is a side elevation view of the magnet holder of FIG. 10.
Figure 10:
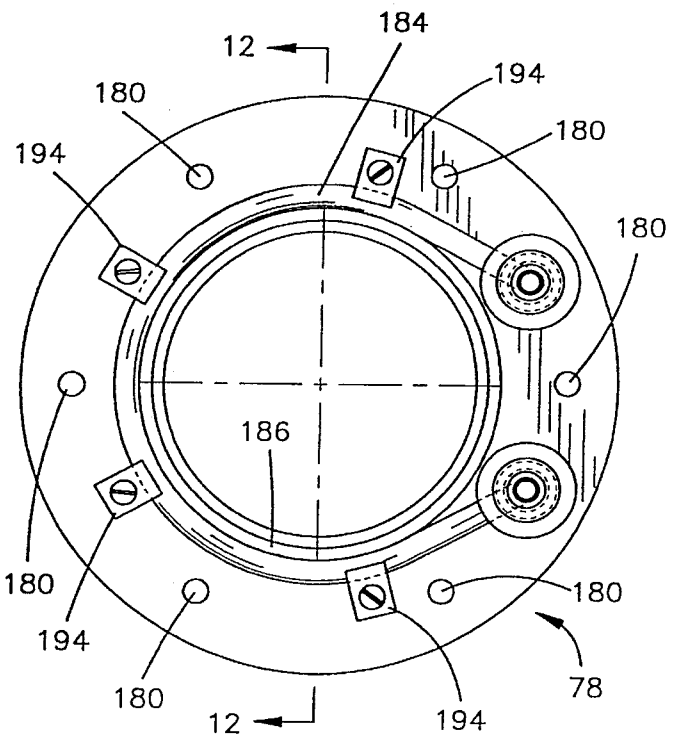
FIG. 10 is a front elevation view of a magnet holder of a magnetic field generating structure of the ion source apparatus of FIGS. 2A–2B.
Figure 12:
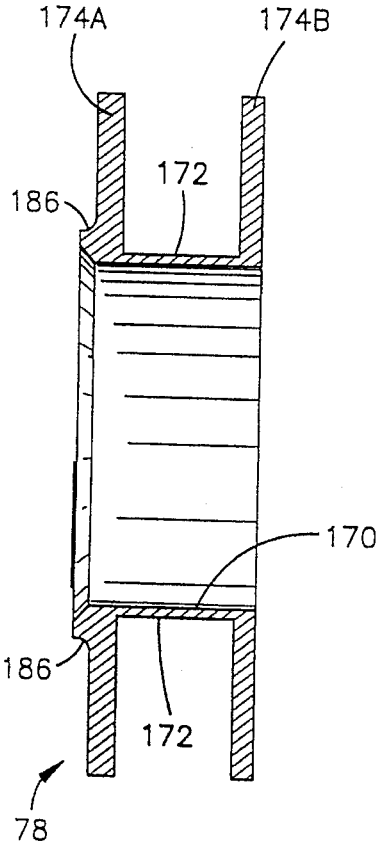
FIG. 12 is a longitudinal sectional view of the magnet holder of FIG. 10 as seen from the plane indicated by line 12—12 in FIG. 10.

As can best be seen in FIGS. 10 and 11, a water cooling tube 184 extends along a ridged portion 186 of a outward facing surface 188 of the magnet holder ring portion extension 174A. The cooling tube 184 terminates in fittings 190 which pass through the ion source apparatus mounting flange 34 and are secured in place with a hex nut 193 (FIG. 4) overlying a sealing O-ring (not shown). An external source of cooling water or fluid (not shown) is coupled to one of the fittings 190 and the cooling water, after circulating through the cooling tube 184, exits through an external tube coupled to the other of fittings 190. The cooling tube 184 is secured to the extension surface 188 by hold-down tabs and screws combinations 194. After assembling the cooling tube 184 to the magnet holder 78, the entire assembly is dip brazed. The cooling tube 184 protects the set of magnets 82 from the extreme heat generated in the nearby plasma chamber 42 and from the plasma chamber heater coil 76.

Turning to FIGS. 2B and 3, an annular electron shield 196 is secured to an outward facing surface 198 of the magnet holder ring portion extension 174B with screws 200 (one of which can be seen in phantom in FIG. 2A and 2B) which thread through aligned apertures in the shield and the ring portion extension 174B. The apertures 202 in the extension 174B are seen in FIG. 13. The electron shield 196 is graphite which prevents damage to the aluminum magnet holder 78 from backstreaming electrons which exit through the plasma chamber cap arc slit 64.

Turning to FIG. 2A and 2B, the microwave tuning and transmission assembly 40 includes the tuner assembly 48 and the microwave energy transmission assembly 52. The tuner assembly 48, functions to tune the frequency of the microwave energy supplied by the microwave generator 20 and is comprised of a waveguide connector 210 coupled to a slug tuner assembly 212. A flanged end 214 of a waveguide connector 210 is connected to an output of the microwave generator 20. Opposite side walls 216, 218 of the waveguide connector 210 include aligned apertures. A center conductor 220 of the slug tuner assembly 212 extends through the aperture in the side wall 216 into an interior region 222 of the waveguide connector 210. A tuner shaft 224 extends through the aperture in side wall 218. The tuner shaft 224 is supported by a flanged sleeve 226 which is mounted overlying the side wall aperture and includes internal threads. The tuner shaft 224 includes threads on a portion of its outer circumference with interfit with the flanged sleeve's internal threads. An end 228 of the tuner shaft 224 protruding outside the waveguide connector interior region 222 is slotted.

Turning the slotted end 228 of the tuner shaft 224 with a screwdriver (not shown) adjusts a depth of tuner shaft 224 extending into the waveguide connector interior region 222. The depth to which the tuner shaft 224 extends into the interior region tunes, that is, changes the impedance of the microwave energy transmitted from the output of the microwave generator 20 to match the impedance of the plasma in the plasma chamber interior region 50.

The microwave energy in the waveguide connector interior region 222 is transferred to the slug tuner center conductor 220. The slug tuner provides a second means of altering the frequency of the microwave energy transmitted to the plasma chamber interior region 50. The slug tuner assembly includes the slug tuner center conductor 220 overlied by an double wall coaxial tuner tube 230 and a pair of slug tuners. The double wall coaxial tuner tube 230 is comprised of silver-plated brass. Each slug tuner includes an annular ceramic tuning collar 236, 238 slideably overlying the slug tuner center conductor 220. Extending radially outwardly from an outer periphery of each of the tuning collars is a thin yoke 240, 242. The yokes 240, 242 are connected with pins 254 through thin longitudinal slots (not shown) in the tuner tube 230 to drive the tuning collars 236, 238. An end portion of each yoke 240, 242 extending outside the outer coaxial tube 230 is coupled to rods 244, 246 which are threaded along their outer diameters and have V-groove ends. Rod 244 is shorter than rod 246.

The long threaded rod 246 passes through a clearance hole in yoke 240 and through a threaded hole in yoke 242 and is secured in place to a stationary support bracket 252 by means of a cone point set screw (not shown). The cone point set screw fits loosely into the V-groove on the end of the threaded rod 246. The short threaded rod 244 passes through a threaded hole in yoke 240 and extends into yoke 242 where it is secured in a similar fashion with a cone point set screw. Turning rod 244 with a screwdriver moves yoke 240 along with pinned tuning collar 236 thereby varying the gap between tuning collars 236, 238. Turning rod 246 with a screwdriver, moves both yokes 240, 242 along with pinned tuning collars 236, 238, in unison along their paths of travel overlying the center conductor 220.

As can be seen in FIG. 2A and 2B, an end of the slug tuner center conductor 220 opposite the waveguide connector 210 is coupled to an end of the microwave energy transmission line center conductor 54. A male member extending from the end of the slug tuner center conductor 220 interfits in an opening in the end of the center conductor 54. An O-ring 256 is disposed between the center conductors to maintain an air tight seal. The vacuum seal 58 is an annular ceramic ring supported by a two piece flange 262 which surrounds the coupling interface between the slug tuner center conductor 220 of the microwave energy transmission line center conductor 54. The two piece flange 262 includes first and second flange portions 264, 266 secured by four bolts 268 (only one of which can be seen in FIG. 2A). An end of the coaxial tuner tube 230 is soldered to the first flange portion 264, while an end of the microwave energy transmission line coaxial tube 56 is soldered to the second flange portion 266. An O-ring 269 surrounding the vacuum seal 58 sealingly engages the second flange portion 266. Holes (not shown) in the coaxial tube 56 permit a vacuum to be drawn in the coaxial tube. The tuner coaxial tube 230 is not under vacuum. The cooling tube 70 which is U-shaped is seated in a ridged portion of an outer face of the second flange portion 266 in proximity to the waveguide coaxial tube 56 to maintain the vacuum seal 58 and O-ring 256 under relatively cool conditions.

The slug tuner and microwave energy transmission line center conductors 220, 54, which transmit the microwave energy, are preferably ⅜ inch in diameter, while the tuner and microwave energy transmission line coaxial tubes 230, 56 are preferably 13/16 inch in inner diameter. An annular collar 270, disposed near a first enlarged portion 272 of the microwave energy transmission line center conductor 54, sized to fit between the center conductor and the coaxial tube 56 centers the conductor within the tube. The collar 270 is secured to the center conductor 54 by a pin 274.

The present invention has been described with a degree of particularity. It is the intent, however, that the invention include all modifications and alterations from the disclosed design falling within the spirit or scope of the appended claims.

We claim:

1. An ion source apparatus comprising:

a) a plasma chamber defining a chamber interior into which source materials and an ionizing gas are routed, the plasma chamber including an opening and a chamber wall spaced from the opening having an energy-emitting surface for injecting energy into the plasma chamber;

b) a plasma chamber cap adapted to sealingly engage the opening in the plasma chamber, the plasma chamber cap including an elongated arc slit through which ions exit the plasma chamber to define an ion beam;

c) structure for supporting the plasma chamber in an evacuated region; and d) an energy transmission assembly for accelerating electrons within the plasma chamber to ionize the gas within the plasma chamber, the energy transmission assembly including:

i) an end portion adapted to abut the plasma chamber wall and transmit energy through the wall to the chamber interior, ii) a transmission for routing microwave or RF energy through a vacuum region to the end portion, and iii) a seal separated at a distance from the end portion along the transmission to isolate the vacuum region of the transmission from a non-vacuum region.

2. The ion source apparatus of claim 1 wherein the apparatus additionally includes a magnetic field generator for generating a magnetic field within the chamber interior such that the magnetic field is axially aligned with the elongated arc slit.

3. The ion source apparatus of claim 1 wherein the transmission comprises a center conductor disposed within an evacuated coaxial tube.

4. The ion source apparatus of claim 3 comprising a tuner assembly coupled to the transmission, the tuner assembly including at least one slug tuner having an annular collar slideably overlying a portion of an energy-transmitting center conductor for altering the frequency of the microwave or RF energy input to the plasma chamber.

5. The ion source apparatus of claim 1 wherein the apparatus includes at least one vaporizer in fluid communication with the chamber interior, the vaporizer adapted to accept source materials and vaporize the source materials which are routed to the chamber interior.

6. The ion source apparatus of claim 5 including a source housing having a recessed portion dimensioned to support the plasma chamber and having at least one passageway to route vapor from an outlet orifice of the vaporizer through an aperture in a plasma chamber wall.

7. The ion source apparatus of claim 6 wherein the source housing includes a heater for providing heat to the chamber interior.

8. The ion source apparatus of claim 1 wherein the wall of the plasma chamber for injecting energy into the chamber interior comprises a wall segment that has a cylindrical side and generally planar end which defines a cavity into which the end portion extends.

9. The ion source apparatus of claim 1 wherein at least a portion of the chamber interior is coated with an inert material.

10. An ion source apparatus supported by a support tube extending into an evacuated cavity defined by an ion source housing assembly, the apparatus comprising:

a) a microwave or RF energy source disposed outside the ion source housing assembly in a non-evacuated region;

b) a plasma chamber disposed within the evacuated cavity and supported by the support tube, the plasma chamber having an open end and defining an interior region into which source materials and ionizable gas are routed and subjected to the energy transmitted to the chamber from the energy source whereby plasma is formed in the chamber and ions are generated;

c) a cap overlying the open end of the plasma chamber and including an elongated arc slit through which generated ions exit the plasma chamber interior region; and d) an energy transmission assembly coupled to the energy source and the plasma chamber for transmitting energy from the energy source and through a vacuum region to the plasma chamber, the energy transmission assembly including:

i) an energy transmitting coaxial transmission line center conductor having an end engaging a portion of an outer wall of the plasma chamber, ii) a coaxial tube overlying the center conductor, at least a portion of the coaxial tube being evacuated to form the vacuum region, and iii) a vacuum seal spaced at a distance from the center conductor end engaging the plasma chamber outer wall portion and forming a vacuum seal between the evacuated portion of the coaxial tube and the non-evacuated region outside the ion source housing assembly.

11. The ion source apparatus of claim 10 wherein the vacuum seal includes a ceramic ring coupled to the center conductor by a flange.

12. The ion source apparatus of claim 10 wherein the plasma chamber includes a recessed portion in the outer wall which interfits with the center conductor end.

13. The ion source apparatus of claim 10 wherein the ion source apparatus includes locating structure for maintaining an axial alignment of the cap arc slit with a predetermined ion beam path.

14. The ion source apparatus of claim 10 wherein the apparatus additionally includes a heater for heating the plasma chamber interior region to a temperature greater than or equal to 800° C.

15. The ion source apparatus of claim 10 wherein the apparatus additionally includes a removable magnet holder fitting around said plasma chamber used in combination with a set of two or more permanent magnets oriented to provide a shaped dipole magnetic field configuration within the plasma chamber interior region.

16. The ion source apparatus of claim 15 wherein the magnet holder is adapted to support different sets of magnets having different orientations to provide shaped hexapole and cusp magnetic field configurations in the plasma chamber interior region.

17. The ion source apparatus of claim 10 including at least one heated vaporizer to vaporize the source materials, the at least one heated vaporizer having an outlet in fluid communication with the plasma chamber interior region.

18. The ion source apparatus of claim 17 wherein the at least one heated vaporizer is removable from the ion source apparatus.

19. An ion source apparatus comprising:

a) a plasma chamber defining an interior region and having an energy interface wall, the plasma chamber having an opening through which ions exit from the interior region of the plasma chamber;

b) a coaxial tube configured to maintain a vacuum region within the coaxial tube;

c) an energy conductor disposed within the coaxial tube for transmitting energy through the vacuum region to an end of the energy conductor;

d) a plasma chamber source housing configured for supporting the plasma chamber and for supporting the end of the energy conductor in relation with the energy interface wall such that energy is transmitted from the energy conductor and through the energy interface wall to the plasma chamber; and e) a vacuum seal separated at a distance from the end of the energy conductor along the energy conductor to isolate the vacuum region of the coaxial tube from a non-vacuum region.

20. The ion source apparatus of claim 19, wherein the energy interface wall of the plasma chamber includes a recessed portion configured for receiving the end of the energy conductor.

21. The ion source apparatus of claim 19, including a magnetic field generator configured with the plasma chamber for generating a magnetic field within the plasma chamber.

22. The ion source apparatus of claim 19, including a cap configured over the opening of the plasma chamber, the cap having a slit through which ions exit from the interior region of the plasma chamber.

23. The ion source apparatus of claim 19, including a heater for heating the interior region of the plasma chamber.

24. The ion source apparatus of claim 19, including a vaporizer configured with the plasma chamber source housing for vaporizing source material to be routed into the interior region of the plasma chamber.

25. The ion source apparatus of claim 19, including a tuner assembly configured with the energy conductor for tuning a frequency of the energy transmitted to the plasma chamber.

26. The ion source apparatus of claim 19, including a microwave energy source coupled to the energy conductor.

27. The ion source apparatus of claim 19, in combination with an ion implantation station.

* * * * *